US005720356A

United States Patent [19]

Gardes

[11] Patent Number: 5,720,356

[45] Date of Patent: Feb. 24, 1998

[54] METHOD AND SYSTEM FOR DRILLING UNDERBALANCED RADIAL WELLS UTILIZING A DUAL STRING TECHNIQUE IN A LIVE WELL

[76] Inventor: Robert Gardes, P.O. Box 92593, Lafayette, La. 70509

[21] Appl. No.: 595,594

[22] Filed: Feb. 1, 1996

[51] Int. Cl.[6] ..... E21B 7/04; E21B 43/12

[52] U.S. Cl. ..... 175/62; 175/70; 166/50

[58] Field of Search ..... 175/61, 62, 69, 175/70; 166/50, 313, 117.5, 117.6

[56] References Cited

U.S. PATENT DOCUMENTS

| | | | |
|---|---|---|---|
| 4,852,666 | 8/1989 | Brunet et al. | 175/62 X |
| 5,394,950 | 3/1995 | Gardes | 175/45 |
| 5,411,105 | 5/1995 | Gray | 175/69 |
| 5,435,400 | 7/1995 | Smith | 175/80 X |

OTHER PUBLICATIONS

Production '91 *Coiled tubing . . . operations and services* Part 1; World Oil, Nov. 1991.

*Coiled tubing . . . operations and services* Part 2; World Oil, Dec. 1991.

*Coiled tubing . . . operations and services* Part 3; World Oil; Jan. 1992.

*Coiled tubing . . . operations and services* Part 6; World Oil; May 1992.

*Coiled tubing . . . operations and services* Part 7; World Oil; Jun. 1992.

*Coiled tubing . . . operations and services;* Part 11, World Oil; Nov. 1992.

*Coiled tubing . . . operations and services;* Part 14; World Oil; Apr. 1993.

*Coiled tubing . . . operations and services;* Part 15; World Oil; May 1993.

*Coiled tubing 1994: Enhanced Value through innovation;* World Oil; Jan. 1994.

*Oryx horizontal well first using coiled tubing;* Drilling Contractor; May 1992.

*The Coiled Tubing Room;* Petroleum Engineer International; Apr. 1991.

Coiled Tubing; *Shell Launches 68–Well Drilling Program Using Coiled Tubing;* Petroleum Engineer International; Sep. 1994.

Coiled Tubing; *Where Is The Coiled Tubing Wave Headed?;* Petroleum Engineer International; Sep. 1994.

Drilling Innovation; *Horizontal Drilling With Coiled Tubing Gains Momentum;* Petroleum Engineer International; Jul. 1992.

Drilling Technology; *Evolution of Coiled Tubing Drilling Technology Accelerates;* Petroleum Engineer International; Sep. 1993.

(List continued on next page.)

*Primary Examiner*—David J. Bagnell

*Attorney, Agent, or Firm*—Pravel, Hewitt, Kimball & Krieger

[57] ABSTRACT

A method and system of drilling multiple radial wells using underbalanced drilling, by first drilling a principal wellbore. There would then be provided a first carrier string having a deflection member on its lowermost end to a certain depth within the principal wellbore. There is then lowered a second drill string, such as coiled tubing, down the bore of the carrier string, so that the drill bit on the end of the second string is deflected by the deflection member in a predetermined direction from the principal wellbore. A second fluid is then pumped into an annular space between the coiled tubing and the carrier string to a position that it co-mingles with the first fluid. The co-mingled fluids and any hydrocarbons are then returned upward to the rig through the annular space between the borehole and the carrier string. There is then provided a volume of fluid to establish an equilibrium within the carrier string. The drill bit at the end of the coil tubing is retrieved from the bore hole. The direction of the deflection member is reoriented to a second depth within the borehole. Finally, the coil tubing and drill bit is lowered to the second depth to drill a second radial well, while the well is alive and producing.

21 Claims, 11 Drawing Sheets

OTHER PUBLICATIONS

Drilling Technology Report OGJ Special; *Coiled tubing used for slim hole re–entry;* Oil & Gas Journal; Feb. 1992.

*Designing slurries for coiled tubing cement squeezes;* World Oil; Jun. 1992.

*Coiled Tubing: A Developing Technology With Reel Potential;* Petroleum Engineer International.

Special Report: Horizontal Drilling; *CT's Future Tied to Horizontal Drilling;* The American Oil & Gas Report; Jul. 1994.

METHOD AND SYSTEM FOR DRILLING UNDERBALANCED RADIAL WELLS UTILIZING A DUAL STRING TECHNIQUE IN A LIVE WELL

BACKGROUND OF THE INVENTION

1. Field of the Invention

The system of the present invention relates to underbalanced multilateral drilling of oil wells. More particularly, the present invention relates to a system for drilling a series of radial wells off of a single wellbore in an underbalanced system, utilizing a two-string technique, without having to kill the well so that all of the radials are drilled while the well is alive.

2. General Background

In the drilling of oil wells, one of the most critical elements in drilling has always been to maintain the well in a balanced state, so that should the drill bit strike a pocket of hydrocarbons, that the formation pressure does not overcome the hydrostatic pressure in the well, and thus a blow out does not occur. In conventional drilling, what has always been done, is during the drilling process, to flow heavy fluids; i.e., muds, into the drill bore or into the oil well bore, during drilling, so that the hydrostatic pressure of the muds within the bore hole is heavier than the pressure from the formation. Therefore, any potential blowout which may occur otherwise is prevented due to the heavy muds which create the higher hydrostatic pressure downward into the formation.

It has been recently found, that when such a hydrostatic head is placed on the formation, often times the heavy muds or fluids flow into the formation, and by doing so, create severe damage of the formation, which is a detriment to the formation and to the productivity of the well itself. Therefore, there has been developed the technique that is called underbalanced drilling, which technique allows for greater production, and does not create formational damage which would impede the production process. Furthermore, it has been shown that productivity is enhanced in multilateral wells combined with the non-formation damaging affects of the underbalanced drilling. These results are accomplished by introducing a lighter fluid such as nitrogen or air into the drill hole, or a combination of same or other type fluids or gases, sufficiently as to create an underbalance so that fluid in the borehole does not move into the formation during drilling. In order to accomplish this, often times the drilling is undertaken through the use of coil tubing, which is a continuous line of tubing which unreels off of a spool on the rig floor, and the tubing serves as a continuous drill string for the drill bit at the end of the tubing. Another technique of underbalanced drilling is referred to as micro-annulus drilling where a low pressure reservoir is drilled with an aerated fluid in a closed system. In effect, a string of casing is lowered into the wellbore and utilizing a two string drilling technique, there is circulated a lighter fluid down the outer annulus, which lowers the hydrostatic pressure of the fluid inside the column, thus relieving the formation. This allows the fluid to be lighter than the formation pressure which, if it weren't, would cause everything to flow into the wellbore which is detrimental. By utilizing this system, drillers are able to circulate a lighter fluid which can return up either inner or outer annulus, which enables them to circulate with a different fluid down the drill string. In doing so, basically air and nitrogen are being introduced down the system which allows them to circulate two different combination fluids with two different strings.

However, when not utilizing a two-string system, the well is being drilled as an underbalanced well. In order to do so, one must kill the well so that the drill string may be tripped out of the hole, until sufficient fluid in the bore to bring the flow to neutral so the wells aren't flowing. When this is done, the fluid which maintains the hydrostatic pressure on the well, may create formation damage because what is actually occurring is sufficient heavy fluid is in the well bore which forces the fluids into the formation thus the well is killed.

Therefore, what is currently being accomplished in the art is the attempts to undertake underbalanced drilling and to trip out of the hole without creating formation damage thereby controlling the pressure, yet hold the pressure so that one can trip out of the well with the well not being killed and maintaining a live well.

It is well known in the art that anytime a heavy fluid must be introduced into the borehole, in order to stop flowing of fluids of the borehole, there is damage being done to the reservoir downhole, which is not desirable. In the prior art which is being submitted with applicant's prior art statement, applicant brings attention to the many articles which have been written on underbalanced drilling, and the techniques which companies are introducing in order to attempt to maintain the wells alive while tripping in and out of the hole. For example, a company called Sperry Sun, in attempting underbalanced drilling, will aerate the fluid into the casing string which lowers the hydrostatic pressure of the well then you proceed to the micro-annulus system which is becoming the method of choice in combination with coiled tubing. However, the basic wells which are being done are regular, singular horizontal wells and even with the micro-annulus system, restricted to a single well either horizontal or vertical.

Therefore, at this time in the art of micro-annulus drilling, what is needed is a system for micro-annulus drilling, utilizing the two string technique, which would allow you to go into drilling multiple radial wells off of the single vertical or horizontal well, without having to kill the well when the radial wells are drilled during the process.

SUMMARY OF THE PRESENT INVENTION

The system and method of the present invention solves the problems in the art in a simple and straight forward manner. What is provided is a system for drilling radial wells from a single vertical or horizontal well, using an underbalanced drilling technique, which provides a first outer casing lining the wellbore, a second inner casing, called a carrier string, as a second inner string, and either coiled tubing or regular drill pipe as the inner drill string. At this point in the process, there would be provided an orientation means for orienting the mud motor assembly off of the coil tubing. There is further provided an orientation sub that attaches to the motor assembly in the coil tubing so that the upstock or whipstock may be oriented in the proper orientation when the radials are drilled through the walls of the casing. Following this orientation, there would be provided a whipstock or upstock attached to the carrier string, which is lowered into the cased or uncased wellbore. The carrier string is lowered into the outer casing, hung off in either the well head or rotary table. Next the inner drilling assembly is lowered into the carrier string and when the drill bit makes contact with the deflecting surface of the whipstock or upstock, there is a bore drilled through the wall of the casing or into the open hole through conventional means depending on the type of material which the casing is constructed of or the type of wellbore to be drilled. In the preferred embodiment, the inner drill string is preferably a continuous string of coiled tubing having a drill bit and a mud motor assembly at the end of the tubing for rotating the drill bit.

It should be known at this time, that although this discussion is centering around a cased borehole, this process as will be discussed can be utilized in the drilling of radial wells in open hole applications, and does not necessarily have to be utilized in conjunction with cased boreholes.

In the process of the underbalanced drilling, a first fluid is circulated down the annulus of the coiled tubing which fluid can be air or nitrogen or water which would drive the mud motor assembly and rotate the drill bit. This would in the preferred embodiment be a non-damaging type fluid which would not cause damage to the surrounding formation. Simultaneously, there would be circulated down the annulus between the outer drill string and the inner drill string a second and different fluid such as aerated nitrogen or water in a combination so as not to cause damage to the formation. The two fluids would then be co-mingled at the point of the drill bit and returned as a co-mingled fluid in the annular space between the carrier string and the casing of the borehole and returned to the separator above the hydrill.

When the drill bit is to be retrieved from drilling a radial well, a kill slug would then be pumped down the annulus between the carrier string and the drill string, the kill slug comprising fluids in a weight ratio to displace the pipe so that the hydrostatic pressure in the carrier string would not allow fluid to flow up the carrier string while the drill string is being retrieved through it so that the clear lighter fluid that was being circulated in combination is still making contact with the formation and the kill slug does not damage the formation and the well is essentially being drilled as a live well within the main well bore. The carrier string with the upstock on its end would then be repositioned at a different point in the borehole, while the well is still alive, and the coiled tubing could be relowered into the borehole to drill the next radial. This drilling of additional radials and various orientations could be accomplished while the well is maintained as a live well, so long as the fluid pressure is underbalanced within the well bore through a combination of fluids in the drill string and carrier string.

Therefore, it is a principal object of the present invention to provide a drilling technique for multiple radials, utilizing an underbalanced system which allows radials to be drilled off of a single borehole while the well is maintained as a live producing well during the process;

It is a further principal object of the present invention to provide a system of underbalanced drilling in drilling radial wells, so that each of the radial wells is drilled while the well is alive, and no damaging fluids or muds make contact with the formation which may do damage to the formation;

It is a further object of the present invention to drill multiple radial wells without having to kill the well in order to drill the additional radial wells;

It is a further object of the present invention to provide a two-string technique in underbalanced drilling so that at least two different fluids are pumped down the annulus's of the coiled tubing or drill pipe, and a second fluid is pumped down the annulus between a carrier string and the inner drill string, so that the co-mingled fluids are returned up to the surface fluid handling facilities through an outer annulus between the casing and the carrier string;

It is the further object of the present invention to provide a two-string drilling technique utilizing coil tubing as a drill string, and a carrier string as the outer string, so that two different fluids can be utilized in an underbalanced drilling system of radial boreholes while the well is being maintained as a live producing well.

It is a further object of the present invention to provide an underbalanced drilling technique for multiple radial wells, by utilizing two different fluids pumped down the borehole with at least one of the fluids making contact with the formation so that the formation is not harmed by the fluid flowing past the formation.

BRIEF DESCRIPTION OF THE DRAWINGS

For a further understanding of the nature and objects of the present invention, reference should be made to the following detailed description taken in conjunction with the accompanying drawings, in which like parts are given like reference numerals, and wherein.

DETAILED DESCRIPTION OF THE PREFERRED EMBODIMENT

Figure 1:
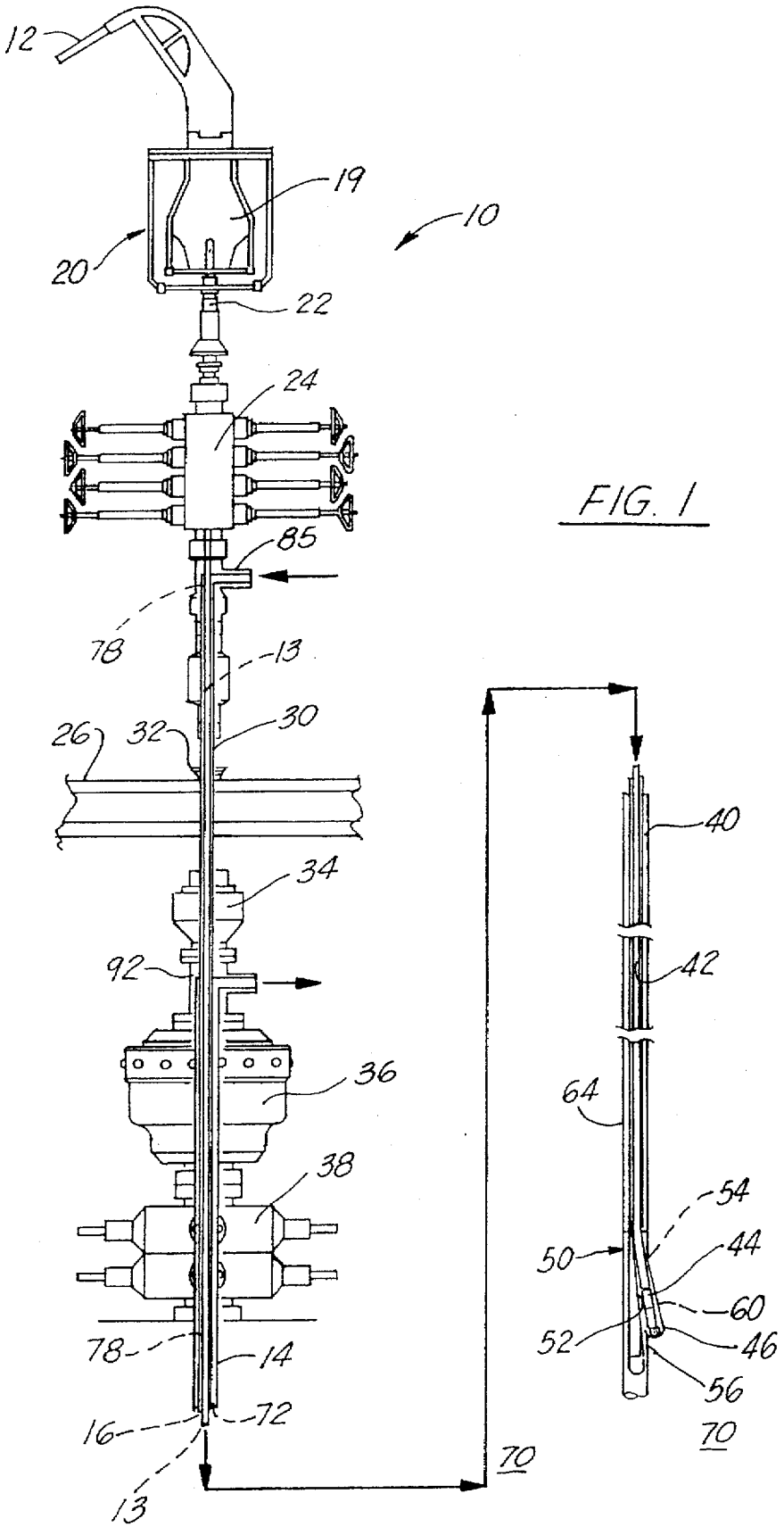
FIG. 1 illustrates an overall view of the two string underbalanced drilling technique utilizing coiled tubing as the drill string in the drilling of multiple radials.

FIGS. 1–9 illustrate the preferred embodiments of the system and method of the present invention for drilling underbalanced radial wells utilizing a dual string technique in a live well. As illustrated in FIG. 1, what is provided is a drilling system 10 utilizing coil tubing as the drill string. As illustrated, the coil tubing 12 which is known in the art, and comprises a continuous length of tubing, which is lowered usually into a cased well having an outer casing 14 placed to a certain depth within the borehole 16. It should be kept in mind that during the course of this application, reference will be made to a cased borehole 16, although the system and method of the present invention may be utilized in a non-cased or "open" borehole, as the case may be. Returning to FIG. 1, the length of coil tubing 12 is inserted into the injector head 19 of the coil tubing assembly 20, with the coil tubing 12 being rolled off of a continuous reel mounted adjacent the rig floor 26. The coil tubing 12 is lowered through the stripper 22 and through the coil tubing blowout preventor stack 24 where it extends down through the rig floor 26 where a carrier string 30 is held in place by the slips 32. Beneath the rig floor 26 there are a number of systems including the rotating drill head 34, the hydrill 36, and the lower BOP stack 38, through which the coil tubing 12 extends as it is moved down the carrier string 30.

Since the system in which the coil tubing 12 is being utilized in this particular application is a system for drilling radial wells, on the lower end of the coil tubing 12, there are certain systems which enable it to be oriented in a certain direction downhole so that the proper radial bore may be drilled from the horizontal or vertical lined cased borehole 16. These systems include a monel drill collar 40, positioned above a muleshoe sub 42, at the end of which includes a mud motor 44, which rotates the drill bit 46 for drilling the radial well. As further illustrated in FIG. 1, on the lower end of the carrier string 30 there is provided a deflector means which comprises an upstock 50, which is known in the art and includes an angulated ramp 52, and an opening 54 in the wall 56 of the upstock 50, so that as the drill bit 46 makes contact with the ramp 52, the drill bit 46 is deflected from the ramp 52 and drills through the wall 56 of the casing 14 for drilling the radial borehole 60 from the cased borehole 16. In a preferred embodiment, there may be a portion of fiberglass casing 64 which has been placed at a predetermined depth within the borehole, so that when the drill bit 46 drills through the wall 56 of the casing 14 at that predetermined depth, the bit easily cuts through the fiberglass and on to drill the radial well.

Following the steps that may be taken to secure the radial bore as it enters into the cased well 14, such as cementing or the like, it is that point that the underbalanced drilling technique is undertaken. This is to prevent any blowout or the like from moving up the borehole 16 onto the rig 26 which would damage the system on the rig or worse yet, injure or kill workers on the rig. As was noted earlier in this application, the underbalanced technique is utilized so that the fluids that are normally pumped down the borehole 16, heavy fluids and muds which are normally dumped down the borehole 16, in order to maintain the necessary hydrostatic pressure, are not utilized. What is utilized in underbalanced drilling, is a combination of fluids which are of sufficient weight to maintain a lower than formation hydrostatic pressure in the borehole yet not to move into the formation 70 which can cause damage.

Figure 2:
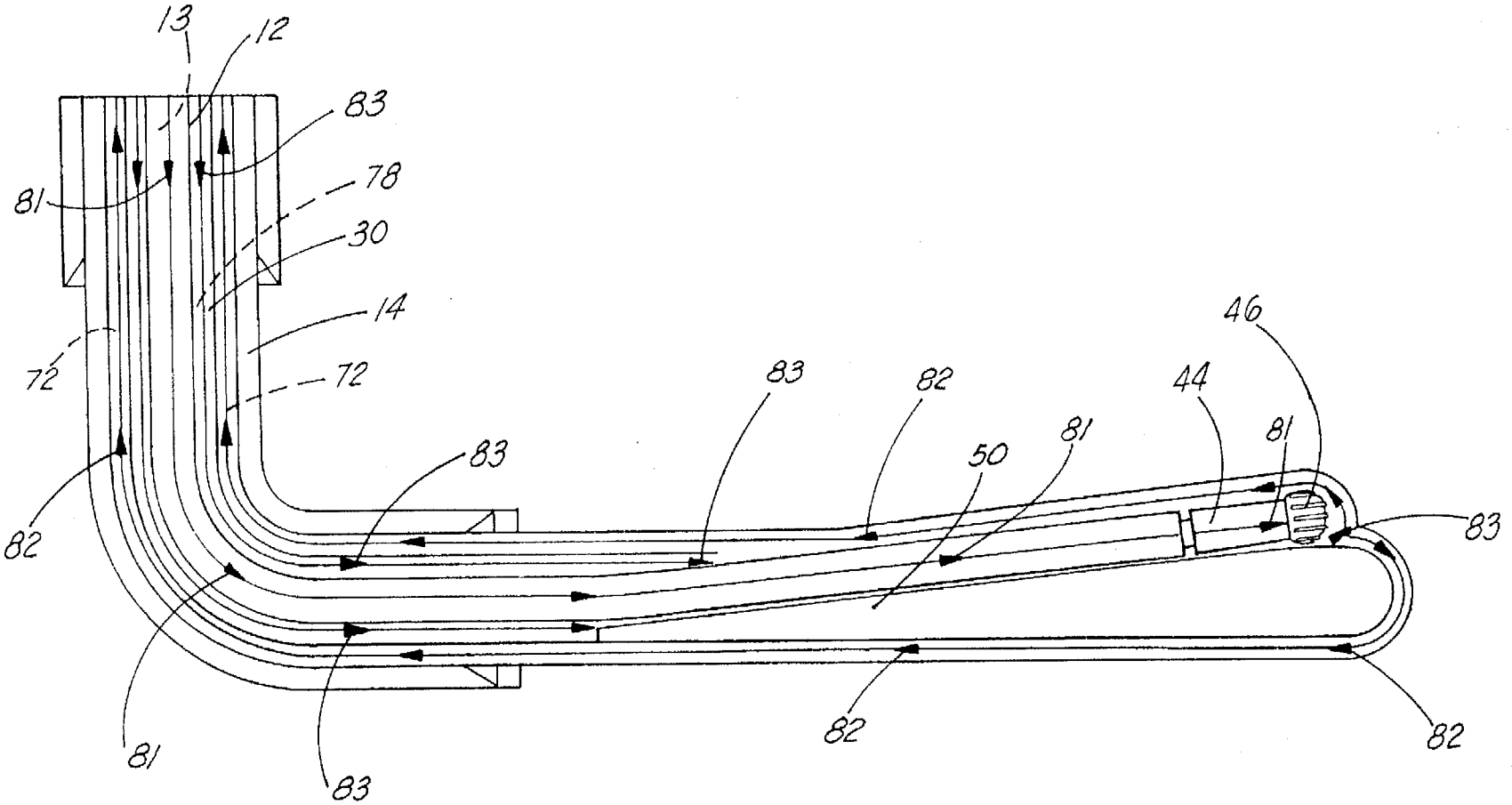
FIG. 2 illustrates a partial cross-sectional view of the whipstock or upstock portion of the two string drilling technique and the fluids flowing therethrough during the underbalanced drilling process.

In order to carry out the method of the system, reference is made to FIGS. 1 and 2. Again, one should keep in mind that the outer casing 14 lines the formation 70, and within the outer casing 14 there is a smaller carrier string 30 casing, which may be a 5" casing, which is lowered into the outer casing 16 thus defining a first annulus 72, between the inner wall of the outer casing 16 and the outer wall of the carrier string 30. The carrier string 30 would extend upward above the rig floor 26 and would receive fluid from a first pump means 76 (see FIG. 6), located on the rig floor 26 so that fluid is pumped within the first annulus 72. Positioned within the carrier string 30 is the coil tubing 12, which is normally 2" in diameter, and fits easily within the interior annulus of the carrier string, since the drill bit 46 on the coil tubing 12 is only 4¾" in diameter. Thus, there is defined a second annulus 78 between the wall of the coil tubing 12 and the wall of the carrier string 30. Likewise, the coil tubing 12 has a continuous bore therethrough, so that fluid may be pumped via a second pump 79 (see FIG. 6) through the coil tubing bore 13 in order to drive the 3⅜" mud motor and drive the 4¾" bit 46.

Therefore, it is seen that there are three different areas through which fluid may flow in the underbalanced technique of drilling. These areas include the inner bore 13 of the coil tubing 12, the first annulus 72 between the outer wall of the carrier string 30 and the inner wall of the outer casing 16, and the second annulus 78 between the coil tubing 12 and the carrier string 30. Therefore, in the underbalanced technique as was stated earlier, fluid is pumped down the bore 13 of the coil tubing 12, which, in turn, rotates the mud motor 44 and the drill bit 46. After the radial well has been begun, and the prospect of hydrocarbons under pressure entering the annulus of the casings, fluids must be pumped downhole in order to maintain the proper hydrostatic pressure. However, again this hydrostatic pressure must not be so great as to force the fluids into the formation. Therefore, in the preferred embodiment, in the underbalanced multilateral drilling technique, nitrogen gas, air, and water is the fluid pumped down the borehole 13 of the coil tubing 12, through a first pump 79, located on the rig floor 36. Again, this is the fluid which drives the motor 44 and the drill bit 46. A second fluid mixture of nitrogen gas, air and water is pumped down the second annulus 78 between the 2" coiled tubing string 12 and the carrier string 30. This fluid flows through second annulus 78 and again, the fluid mixture in annulus 78 in combination with the fluid mixture through the bore 13 of the coil tubing 12 comprise the principal fluids for maintaining the hydrostatic pressure in the underbalanced drilling technique. So that the first fluid mixture which is being pumped through the bore 13 of the coil tubing 12, and the second fluid mixture which is being pumped through the second annular space 78 between the carrier string 30 and the coil tubing 12, reference is made to FIG. 2 in order understand the manner in which the fluid is returned up to the rig floor 26 so that it does not make contact with the formation.

Figure 6:
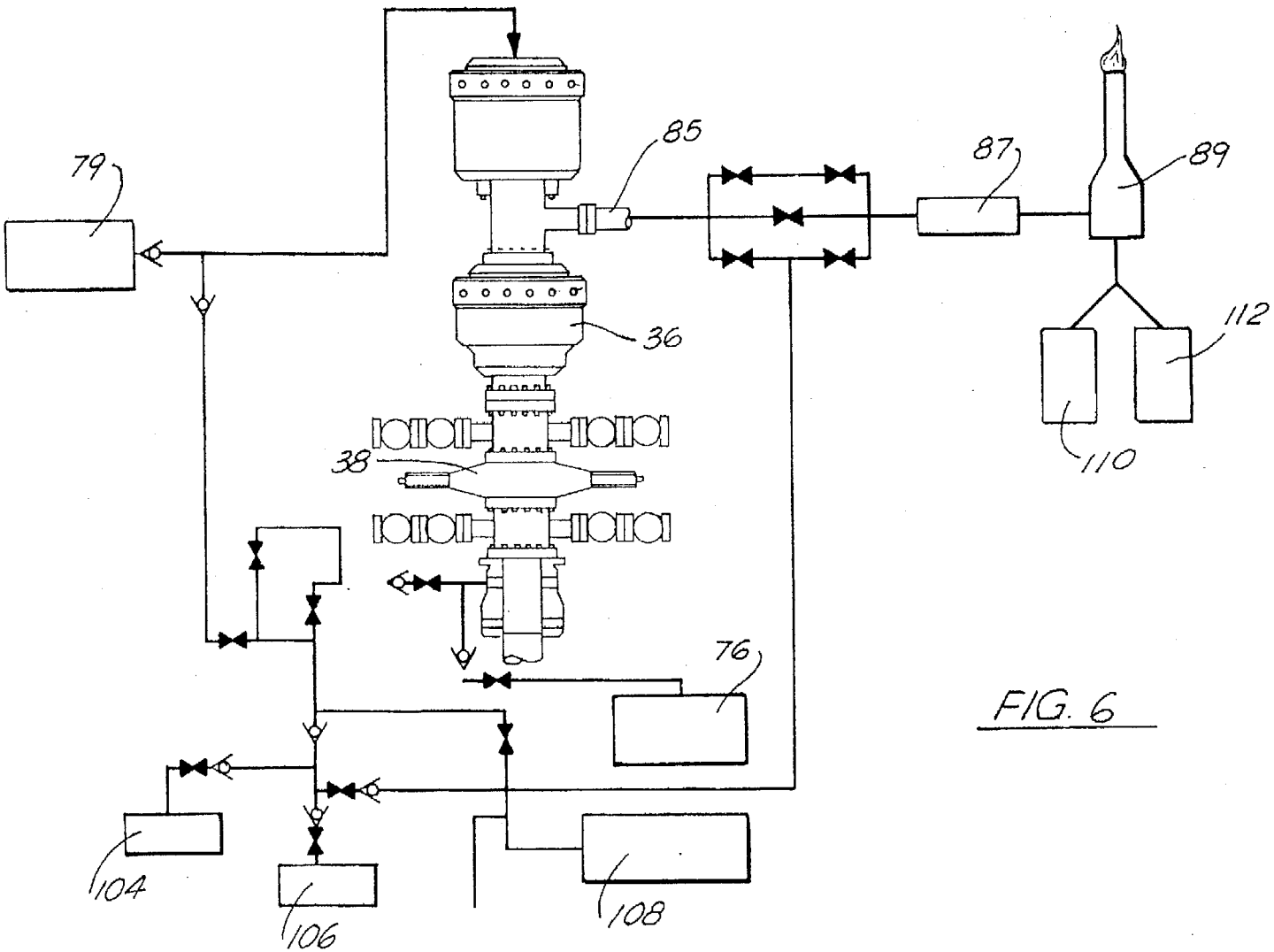
FIG. 6 illustrates an overall schematic view of an underbalanced drilling system utilized in the system of the method of the present invention.

As seen in FIG. 2, the fluid mixture through the bore 13 of the coil tubing 12 flows through the bore 13 and drives the mud motor 44 and flows through the drill bit 46. Simultaneously the fluid mix is flowing through the second annular space 78 between the carrier string 30 and the coil tubing 12, and likewise flows out of the upstock 50. However, reference is made to the first annular space between the outer casing 14 and the carrier string 30, which is that space 72 which returns any fluid that is flowing downhole back up to the rig floor 26. As seen in FIG. 2, arrows 81 represent the fluid flow down the bore 13 of the coil tubing 12, arrows 83 represent the second fluid flowing through the second annular space 78 into the borehole 12, and arrow 82 represents the return of the fluid in the first annular space 72. Therefore, all of the fluid flowing into the drill bit 46 and into the bore 12 so as to maintain the hydrostatic pressure is immediately returned up through the outer annular space 72 to be returned to the separator 87 through pipe 85 as seen in FIGS. 1 & 6.

During the drilling technique should hydrocarbons be found at one point during this process, then the hydrocarbons will likewise flow up the annular space 72 together with the return air and nitrogen and drilling fluid that was flowing down through the tube flowbores or flow passageways 13 and 78. At that point, the fluids carrying the hydrocarbons if there are hydrocarbons, flow out to the separator 87, where in the separator 87, the oil is separated from the water, and any fumes then go to the flare stack 89 (FIG. 6). This schematic flow is seen in FIG. 6 of the application.

Figure 3C:
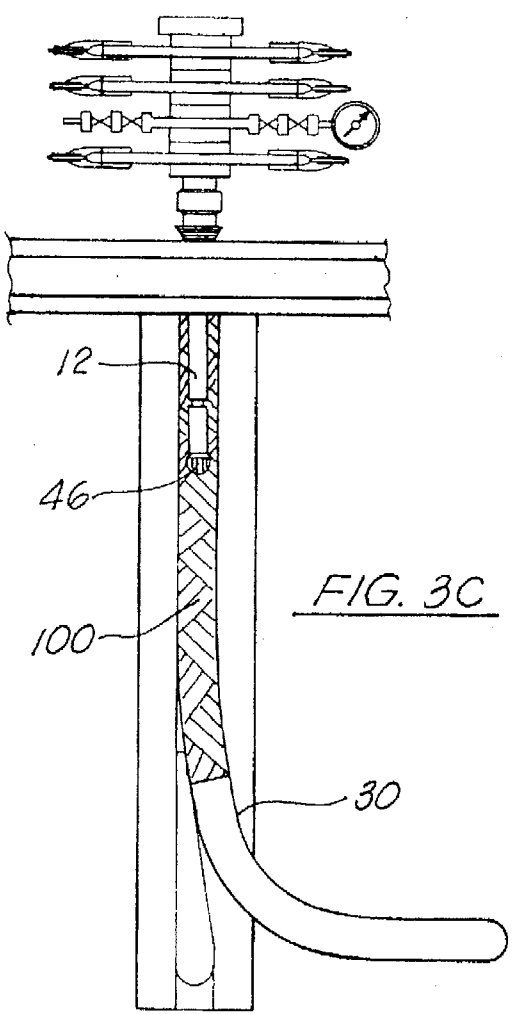
FIGS. 3A–3C illustrate views of the underbalanced drilling technique utilizing the fluid for maintaining the underbalanced status of the well during a retrieval of the coiled tubing drill string.
Figure 3B:
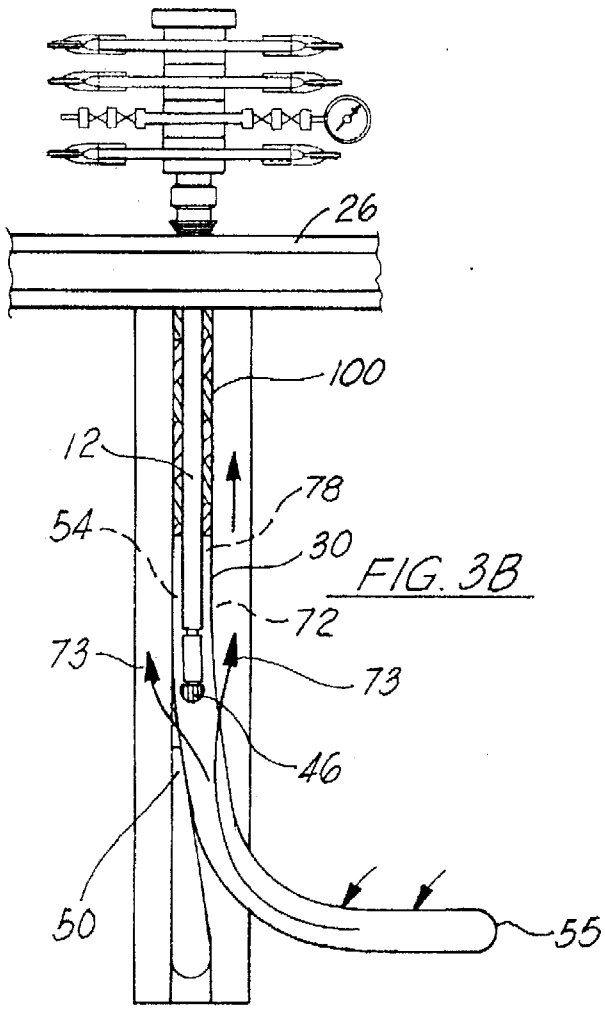
Figure 3A:
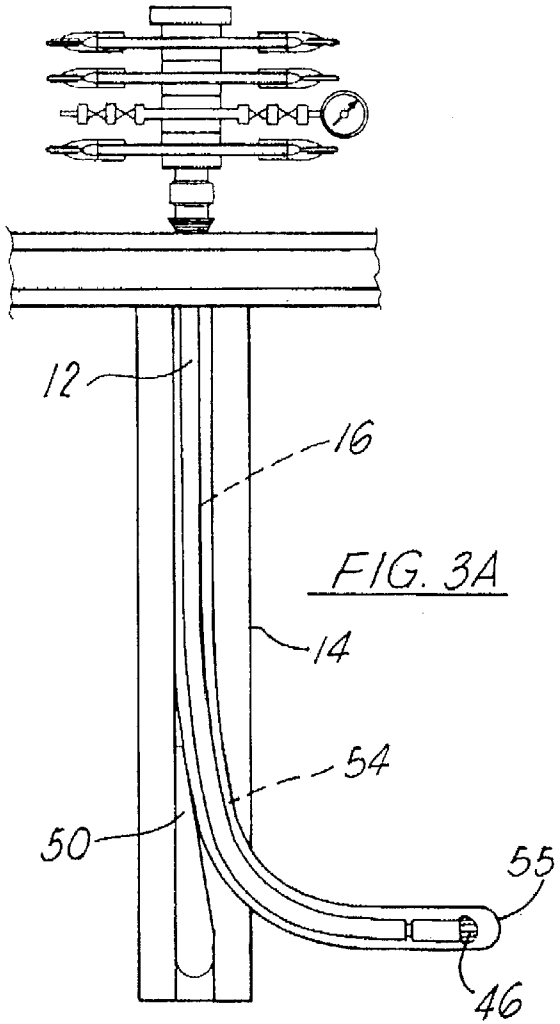

One of the more critical aspects of this particular manner of drilling wells in the underbalanced technique, is the fact that the underbalanced drilling technique would be utilized in the present invention in the way of drilling multiple radial wells from one vertical or horizontal well without having to kill the well in order to drill additional radials. This was discussed earlier. However, as illustrated in FIGS. 3A–3C, reference is made to the sequential drawings, which illustrate the use of the present invention in drilling radial wells. For example, as was discussed earlier, as seen in FIG. 3A, when the coil tubing 12 encounters the upstock 50, and bores through an opening 54 in the wall of outer casing 14, the first radial is then drilled to a certain point 55. At some point in the drilling, the coil tubing string 12 must be retrieved from the borehole 16 in order to drill additional radials. In the present state of the art, what is normally accomplished is that the well is killed in that sufficient weighted fluid is pumped into the wellbore to stop the formation from producing so that there can be no movement upward through the borehole by hydrocarbons under pressure while the drill string is being retrieved from the hole and subsequently completed.

This is an undesirable situation. Therefore, what is provided as seen in FIGS. 3B and 3C, where the coil tubing 12, when it begins to be retrieved from the hole, there is provided a kill slug 100, lowered into the second annular space 78 between the wall of the coil tubing 12 and the wall of the carrier string 30. This kill slug 100 is a combination of fluids, which are sufficient to maintain any hydrocarbons from flowing through the carrier string 30 upward, yet do not go into the formation. Rather, if there are hydrocarbons which flow upward they encounter the kill slug 100 and flow in the direction of arrows 73 through the first annular space 72 between the carrier string 30 and the outer casing 14, and flow upward to the rig floor 26 and into the separators 87 as was discussed earlier. However, the carrier string 30 is always "alive" as the coil tubing 12 with the drill bit 46 is retrieved upward. As seen in FIG. 3C, the kill slug 100 is placed to a certain depth 102 within the carrier string 30, so that as the drill bit 46 is retrieved from the bore of the carrier string 30, the kill slug 100 maintains a certain equilibrium within the carrier string 30, and the well is maintained alive.

Figure 5:
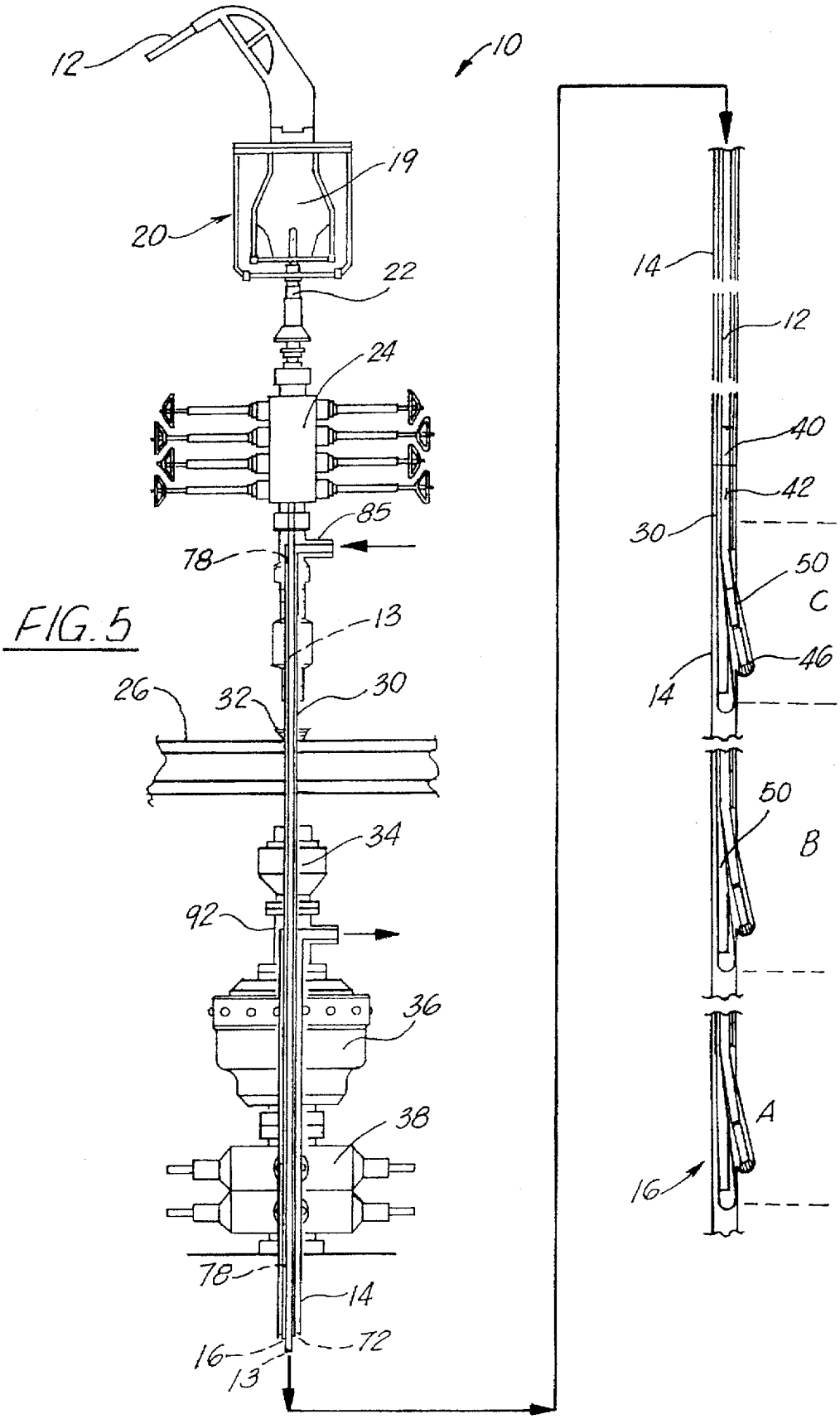
FIG. 5 illustrates a partial view of the underbalanced drilling technique showing the drilling of multiple radial wells from a single vertical or horizontal well while the well is maintained in the live status within the bore hole.

Therefore, FIG. 5 illustrates the utilization of the technique as seen in FIGS. 3A–3C, in drilling multiple radials off of the vertical or horizontal well. As illustrated for example, in FIG. 5, a first radial would be drilled at point A along the bore hole 16, utilizing the technique of the kill slug 100 as described in FIG. 3C. Maintaining the radial well in the underbalanced mode, through the use of kill slug 100, the drill bit 46 and coil tubing 12 is retrieved upward, and the upstock 50 is moved upward to a position B as illustrated in FIG. 5. At this point, a second radial well is drilled utilizing the same technique as described in FIG. 3, until the radial well is drilled and the kill slug forms an underbalanced well at that point. The coil tubing 12 with the bit 46 is retrieved once more, to level C at which point a third radial well is drilled. It should be kept in mind that throughout the drilling of the three wells at the three different levels A, B, C, the hydrostatic pressure within the carrier string 30 will be maintained as a balanced pressure, and any hydrocarbons which may flow, may flow upward within annulus 72 between the carrier string 30 and the outer casing 14. Therefore, utilizing this technique, each of the three wells are drilled and completed as live wells, and the multiple radials can be drilled while the carrier string 30 is alive as the drill bit 46 and carrier string 30 are retrieved upward to another level.

Figure 4A:
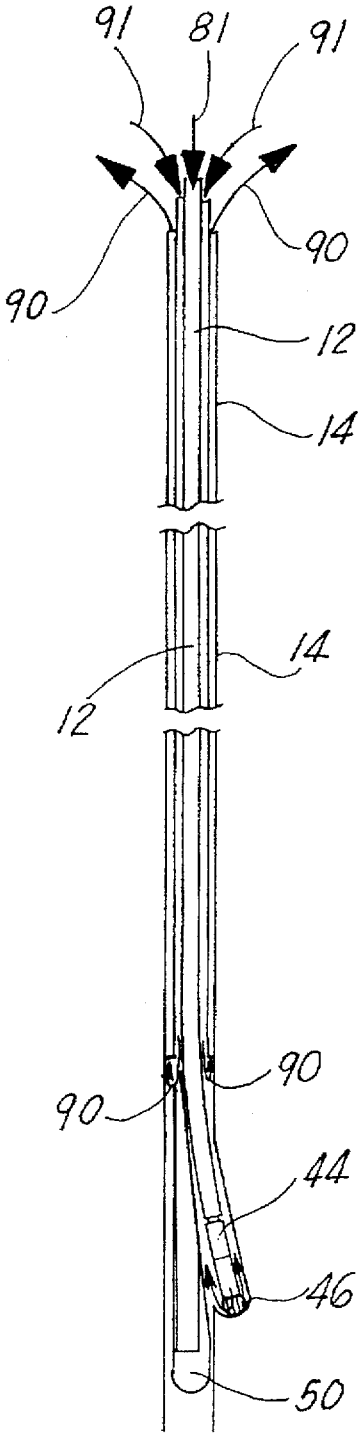
FIGS. 4A & 4B illustrate a flow diagram for under drilling utilizing a two-string drilling technique in an upstock assembly with the fluid being returned through the annulus between the drill string and the carrier string.
Figure 4B:
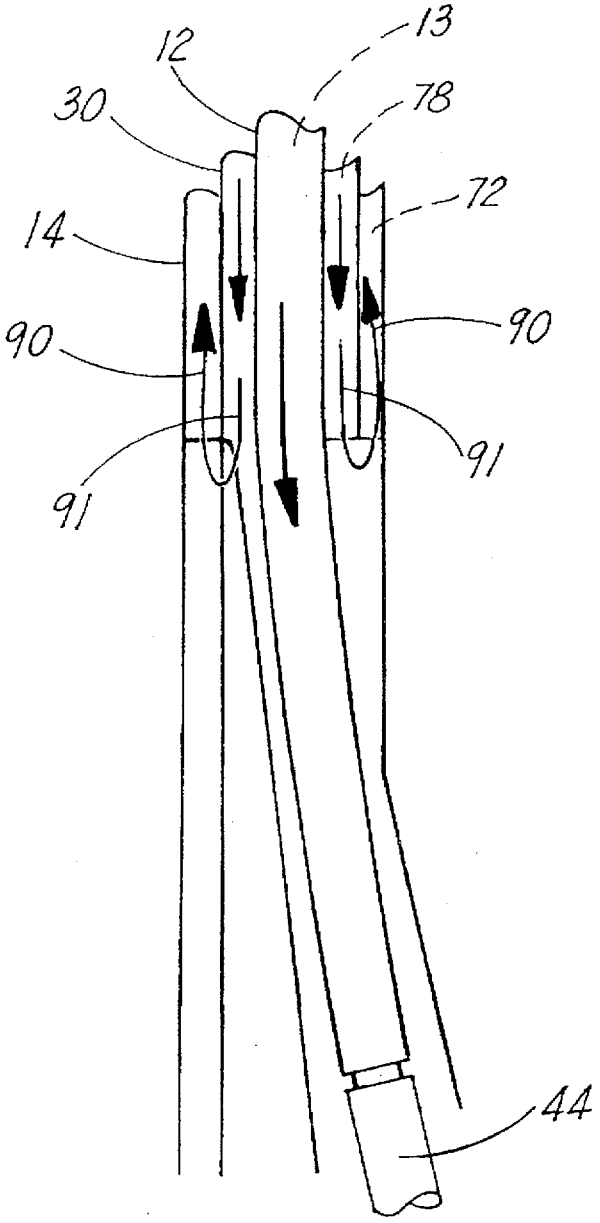

FIGS. 4A and 4B illustrate a the two string drilling technique, whereas as seen in 4A the coil tubing 12 with the drill bit 46 on its end is drilling a radial well, with the drill bit being driven by mud motor 44. The coil tubing is housed within carrier string 30, with carrier string 30 housed within outer casing 14. As seen in FIGS. 4A and in isolated view in 4B, the fluid is pumped down the bore of coil tubing 12 (arrows 81), and is returned up the annulus between carrier string 30 and the outer casing 14 (arrows 90), while additional fluid 81 is pumped down the annulus between the coil tubing 12 and the carrier string 30 (arrows 91), as seen in FIG. 4B, to enhance the movement of the fluid therethrough.

FIG. 6 is simply an illustration in schematic form of the various nitrogen units 104, 106, and rig pumps 76, 79 including the air compressor 108 which are utilized in order to pump the combination of air, nitrogen and drilling fluid down the hole during the underbalanced technique and to likewise receive the return flow of air, nitrogen, water and oil into the separator 87 where it is separated into oil 110 and water 112 and any gases are then burned off at flare stack 89. Therefore, in the preferred embodiment, this invention, by utilizing the underbalanced technique, numerous radial wells 60 can be drilled off of a borehole 16, while the well is still alive, and yet none of the fluid which is utilized in the underbalanced technique for maintaining the proper equilibrium within the borehole 16, moves into the formation and causes any damage to the formation in the process.

Figure 7A:
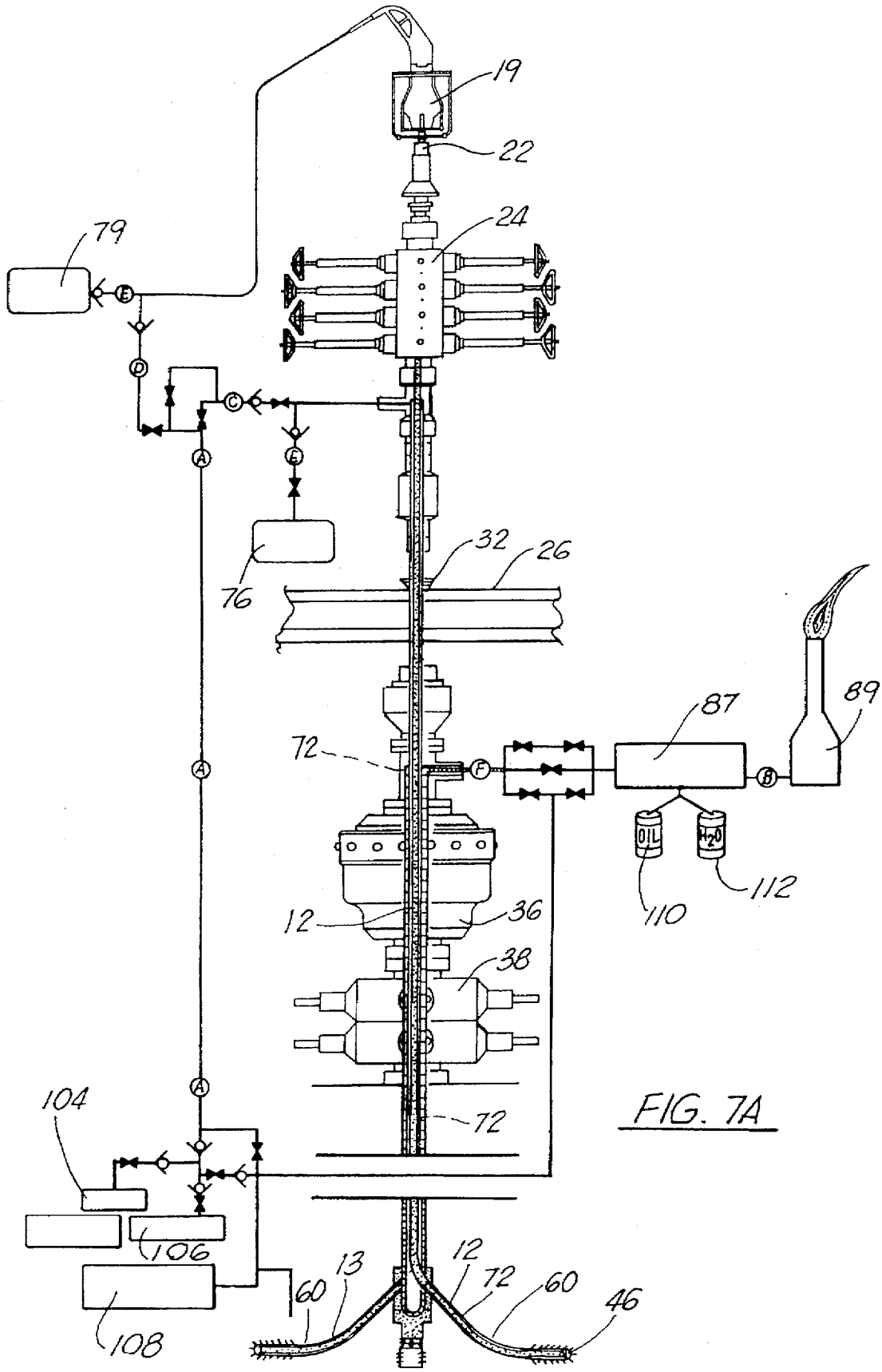
FIG. 7A illustrates an overall schematic view of an underbalanced radial drilling (with surface schematic) while producing from a wellbore being drilled, and a wellbore that has been drilled and is currently producing, with FIG. 7B illustrating a partial view of the system.
Figure 7B:
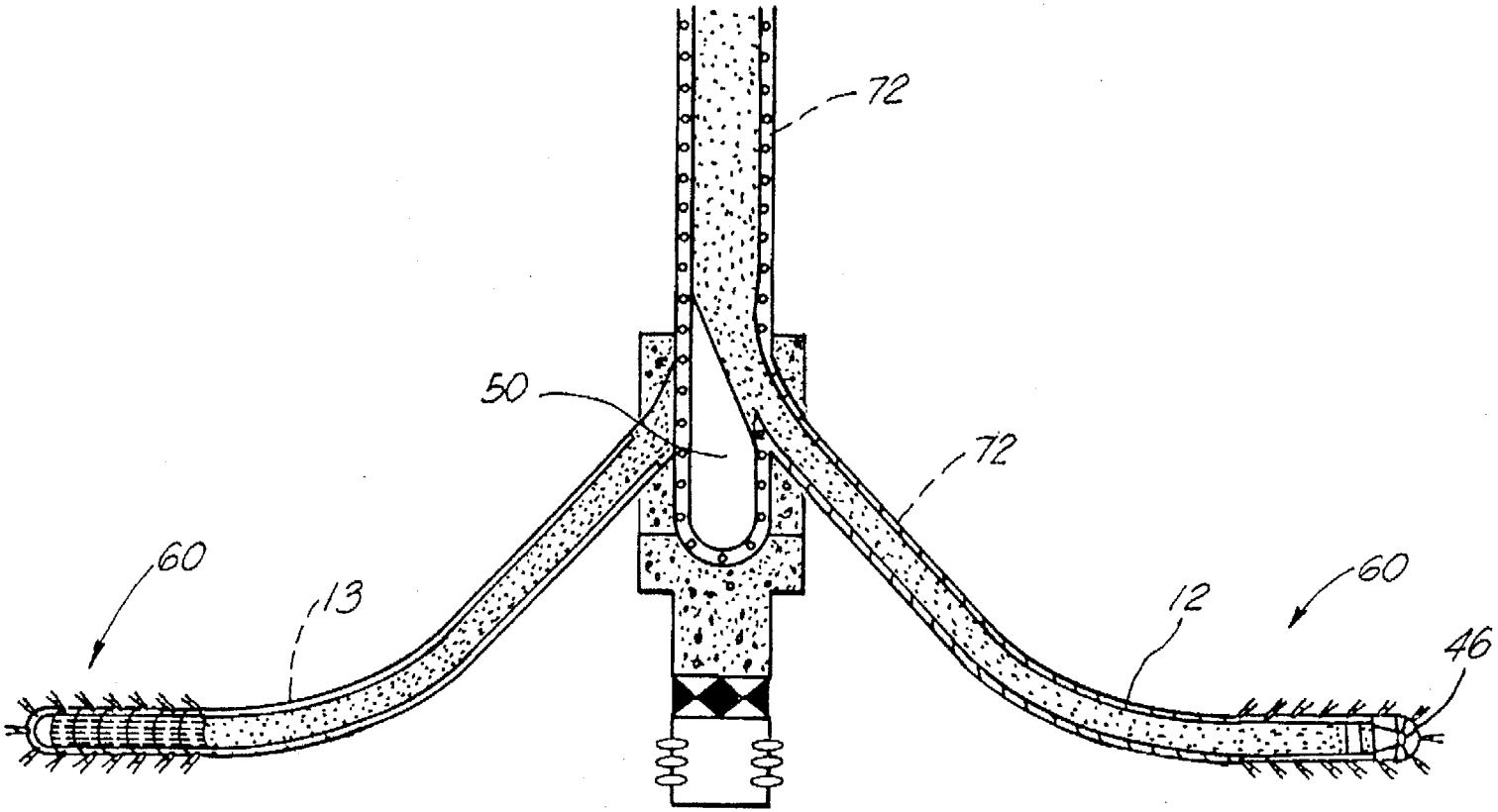

FIGS. 7A and 7B illustrate in overall and isolated views respectively, the well producing from a first radial borehole 60 while the radial borehole is being drilled, and is likewise simultaneously producing from a second radial borehole 60 after the radial borehole has been completed. As is illustrated, first radial borehole 60 being drilled, the coil tubing string 12 is currently in the borehole 60, and is drilling via drill bit 46. The hydrocarbons which are obtained during drilling return through the radial borehole via annulus 72 between the wall of the borehole, and the wall of the coiled tubing 12. Likewise, the second radial borehole 60 which is a fully producing borehole, in this borehole, the coil tubing 12 has been withdrawn from the radial borehole 60, and hydrocarbons are flowing through the inner bore of radial borehole 60 which would then join with the hydrocarbon stream moving up the borehole via first radial well 60, the two streams then combining to flow up the outer annulus 72 within the borehole to be collected in the separator. Of course, the return of the hydrocarbons up annulus 72 would include the air/nitrogen gas mixture, together with the drilling fluids, all of which were used downhole during the underbalanced drilling process discussed earlier. These fluids, which are comingled with the hydrocarbons flowing to the surface, would be separated out later in seperator 87.

Figure 8A:
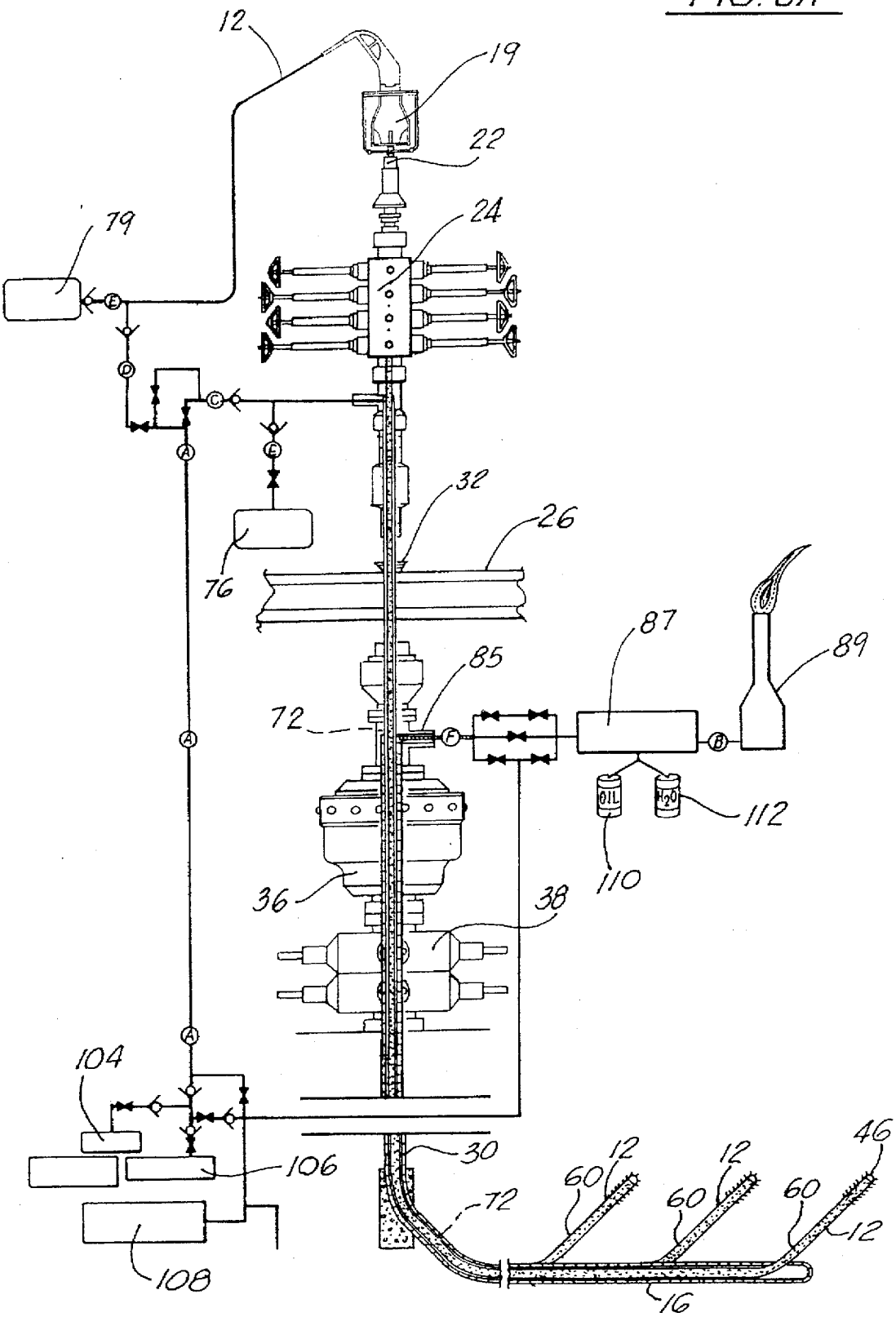
FIG. 8A illustrates an overall schematic view of underbalanced horizontal radial drilling (with surface schematic) while producing from a radial wellbore being drilled, and additional radial wellbores that have been drilled, with FIG. 8B illustrating a partial view of the system.
Figure 8B:
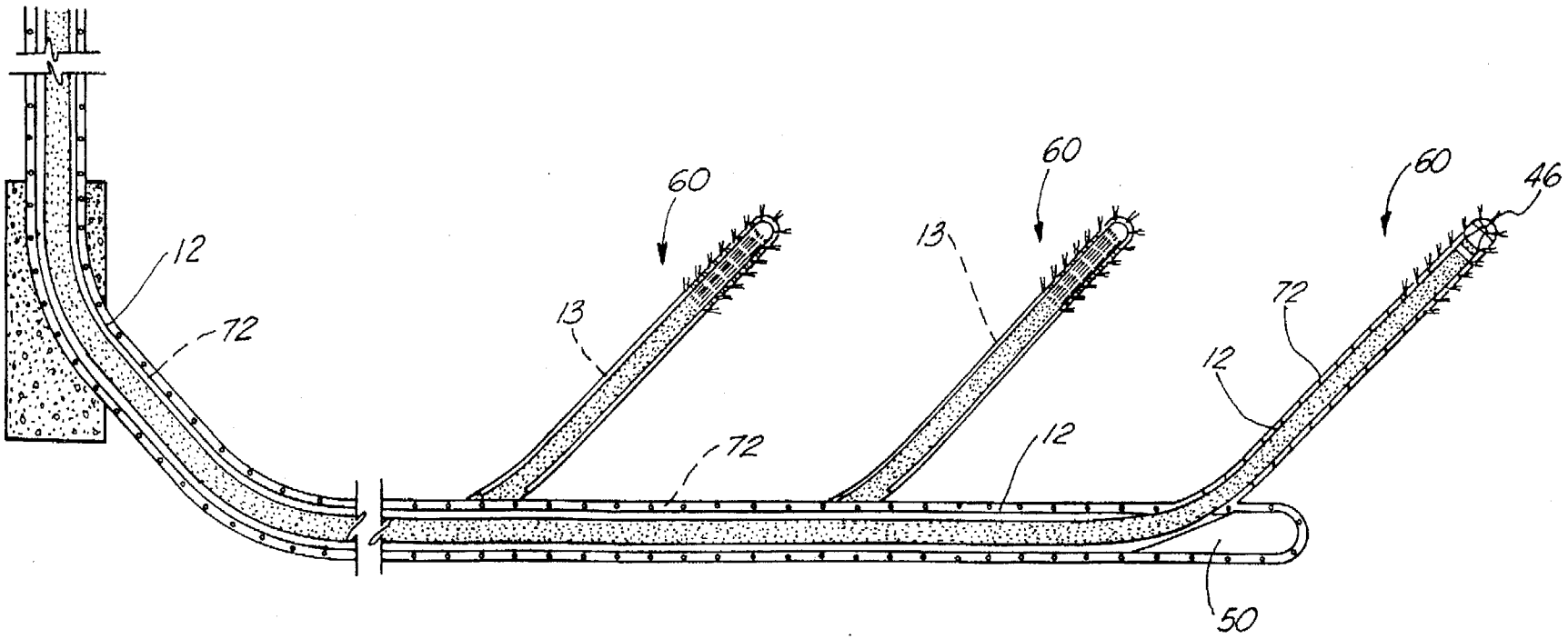

Likewise, FIGS. 8A and 8B illustrate the underbalanced horizontal radial drilling technique wherein a series of radial boreholes. 60 have been drilled from a horizontal borehole 16. As seen in FIG. 7A, the furthest most borehole 60 is illustrated as being producing while being drilled with the coil tubing 12 and the drill bit 46. However, the remaining two radial boreholes 60 are completed boreholes, and are simply receiving hydrocarbons from the surrounding formation 70 into the inner bore of the radial boreholes 60. As was discussed in relation to FIGS. 7A and 7B, the hydrocarbons produced from the two completed boreholes 60 and the borehole 60 which was currently being drilled, would be retrieved into the annular space 72 between the wall of the borehole and the carrier string 30 within the borehole and would likewise be retrieved upward to be separated at the surface via separator 87. And, like the technique as illustrated in FIGS. 7A and 7B, the hydrocarbons moving up annulus 72 would include the air/nitrogen gas mixture and the drilling fluid which would be utilized during the drilling of radial well 60 via coil tubing 12, and again would be comingled with the hydrocarbons to be separated at the surface at separator 87. As was discussed earlier and as is illustrated, all other components of the system would be present as was discussed in relation to FIG. 6 earlier.

Figure 9:
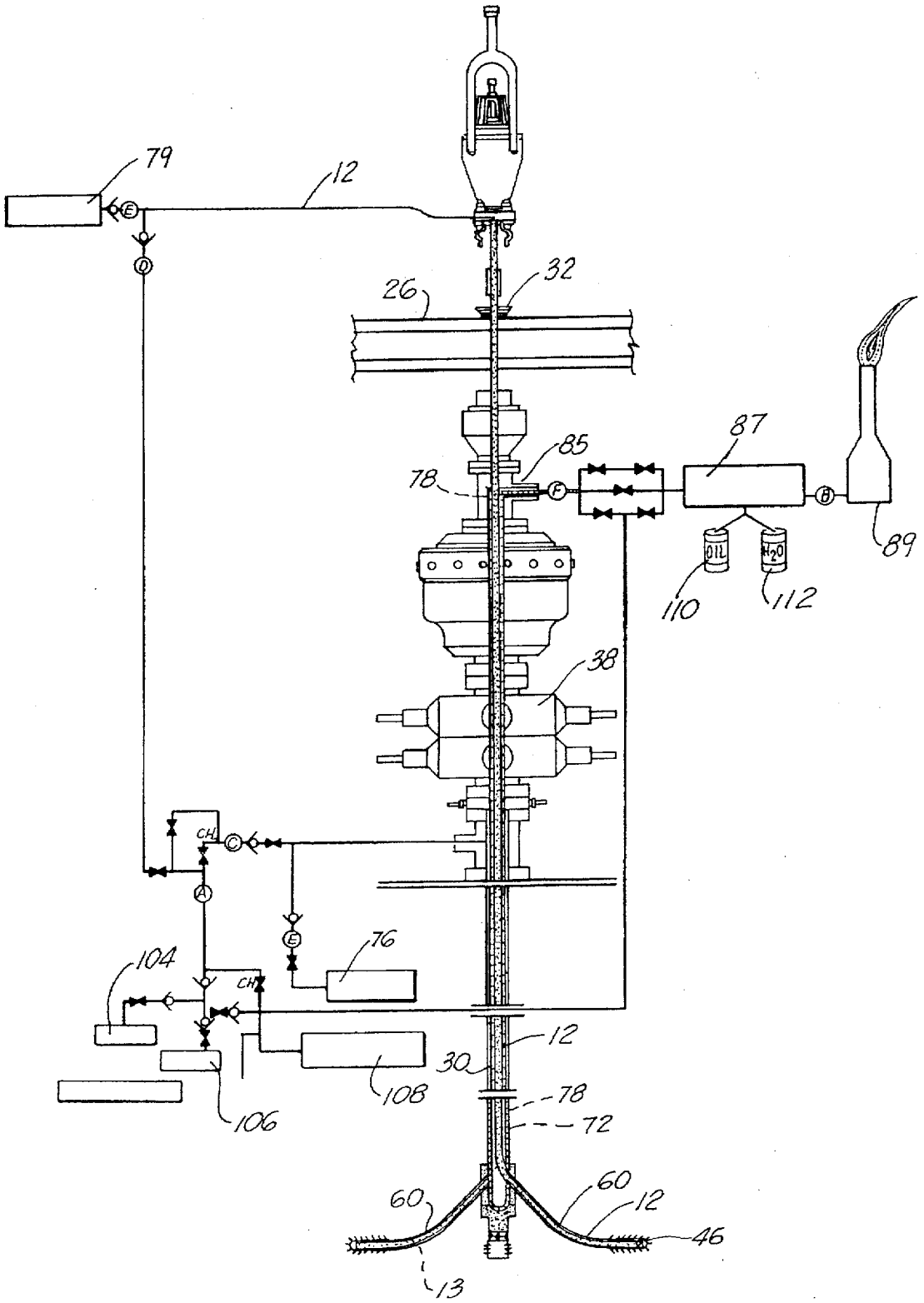
FIG. 9 illustrates a flow diagram for underbalanced drilling using the two string drilling technique with the upstock assembly where there is a completed radial well that is producing and a radial well that is producing while drilling.

Turning now to FIG. 9, the system illustrated in FIG. 9 again is quite similar to the systems illustrated in FIGS. 7A, 7B and 8A, 8B and again illustrate a radial borehole 60 which is producing while being drilled with coil tubing 12 and drill bit 46. The second radial well 60 is likewise producing. However, this well has been completed and the hydrocarbons are moving to the surface via the inner bore within the radial bore 60 to be joined with the hydrocarbons from the first radial well 60. Unlike the drilling techniques as illustrated in FIGS. 7 and 8, FIG. 9 would illustrate that the hydrocarbons would be collected through the annular space 78 which is that space between the wall of the coil tubing 12 and the wall of the carrier string 30. That is, rather than be moved up the outermost annular space 72 as illustrated in FIGS. 7 and 8, in this particular embodiment, the hydrocarbons mixed with the air/nitrogen gas and the drilling fluids would be collected in the annular space 78, which is interior to the outermost annular space 72 but would likewise flow and be collected in the separator for separation. Although this is a particular embodiment, it is not necessarily the preferred embodiment, in view of the fact that the annular space 78 is somewhat reduced than the annular space 72 and therefore, the flow of the hydrocarbons to be collected on the surface would be slower and therefore would not be as efficient as seen in the embodiment shown in FIGS. 7 and 8. However, as illustrated in all other respects, the system would operate substantially the same as the system shown in FIGS. 7 and 8 with the same components as discussed earlier.

The following table lists the part numbers and part descriptions as used herein and in the drawings attached hereto.

PARTS LIST

| Description | Part No. |
|---|---|
| drilling system | 10 |
| coil tubing | 12 |
| bore | 13 |
| outer casing | 14 |
| bore hole | 16 |
| injector head | 19 |
| tubing assembly | 20 |
| stripper | 22 |
| stack | 24 |
| rig floor | 26 |
| carrier string | 30 |
| slips | 32 |
| drill head | 34 |
| hydrill | 36 |
| BOP stack | 38 |
| casing head | 39 |
| monel drill collar | 40 |
| mule shoe sub | 42 |
| mud motor | 44 |
| drill bit | 46 |
| upstock | 50 |

-continued

PARTS LIST

| Description | Part No. |
|---|---|
| angulated ramp | 52 |
| opening | 54 |
| point | 55 |
| wall | 56 |
| radial bore hole | 60 |
| fiberglass casing | 64 |
| formation | 70 |
| first annulus | 72 |
| arrow | 73 |
| first pump means | 76 |
| second annulus | 78 |
| second pump | 79 |
| arrows | 81 |
| arrows | 83 |
| pipe | 85 |
| pits | 86 |
| separator | 87 |
| flare stack | 89 |
| spool | 92 |
| point | 98 |
| kill slug | 100 |
| depth | 102 |
| nitrogen units | 104, 106 |
| air compressor | 108 |
| oil | 110 |
| water/drilling fluid | 112 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A method of drilling multiple radial wells in an underbalanced non-formation damaging environment comprising the following steps:

a) drilling a first radial well in an underbalanced condition;

b) providing a fluid of sufficient weight to maintain a hydrostatic pressure less than formation pressure in the borehole without the fluid entering the formation;

c) retrieving a drill string into a carrier string and reorienting an upstock and said carrier string to drill a second radial well; and d) maintaining the first radial well as a live well so that other radial wells may be drilled and completed while the well is producing.

2. The method in claim 1, wherein the first radial well is drilled with a drill bit at the end of coiled tubing or drill string.

3. The method in claim 2, wherein the drill bit is driven by a fluid comprising nitrogen gas and drilling fluid pumped down the coiled tubing or drill string.

4. The method in claim 2, wherein the fluid flowing down the coiled tubing co-mingles with fluid flowing down a carrier string, and returns to a rig floor through an outer annular space between the carrier string and a borehole and comprises a mixture of air, nitrogen gas, drilling fluid and hydrocarbons.

5. The method in claim 1, wherein the fluid provided in the borehole allows the first radial well to continue to produce, but allows the drilling of additional radial wells off of the principal borehole.

6. The method in claim 1, further comprising a second fluid of nitrogen gas and drilling fluid within the annulus of a carrier string positioned within the borehole.

7. The method in claim 1, wherein an equilibrium established in the carrier string is defined by a slug of heavy fluid introduced into the annulus of the carrier string, so that the coiled tubing may be pulled from the carrier string while maintaining the well as a live producing well on the outer annulus, so that other radial wells may be drilled.

8. The method in claim 1, wherein a third fluid returning to the rig floor is routed to a separator to separate the drilling fluid, gas from the liquid hydrocarbons.

9. A method of drilling multiple radial wells in the well using underbalanced drilling, comprising the following steps:

a) drilling a principal wellbore;

b) providing a first carrier string having a deflection member on its lowermost end to a certain depth within the principal wellbore;

c) lowering a second drill string of coiled tubing, down the bore of the carrier string, so that the drill bit on the end of the second string is deflected by the deflection member in a direction from the principal wellbore;

d) pumping a second fluid into an annular space between the coiled tubing and the carrier string to a position that it co-mingles with the first fluid;

e) returning the co-mingled fluids and any hydrocarbons upward to the rig through the annular space between the borehole and the carrier string;

f) providing a volume of liquid within the carrier string;

g) retrieving the drill bit at the end of the coil tubing from the bore hole;

h) reorienting the direction of the deflection member to a second depth within the borehole; and i) lowering the coil tubing and drill bit to the second depth to drill a second radial well, while the well is maintained alive.

10. The method in claim 9, wherein the first fluid within the coil tubing comprises a mixture of nitrogen gas, drilling fluid or just and air or just drilling fluid.

11. The method in claim 9, wherein the second fluid within the annulus of the carrier string comprises nitrogen gas, drilling fluid and air.

12. The method in claim 9, wherein the co-mingled fluids flowing returns to a rig floor through the outer annular space comprises a mixture of air, nitrogen gas, drilling fluid and hydrocarbons.

13. The method in claim 9, wherein a drilling component may comprise coiled tubing or drill pipe.

14. The method in claim 9, wherein the fluid introduced into the carrier string provides an equilibrium downhole, so that the coiled tubing may be pulled from the carrier string while maintaining the well as a live well, so that other radial wells may be drilled.

15. The method in claim 9, wherein the third fluid returning to a rig floor is routed to a separator to separate the gas and water from the hydrocarbons.

16. A method of drilling radial wells using underbalanced drilling, comprising the following steps:

a) drilling a principal wellbore;

b) providing a first carrier string having a deflection member on its lowermost end to a certain depth within the principal wellbore;

c) lowering a second drill string of coiled tubing, down the bore of the carrier string, so that the drill bit on the end of the second string is deflected by the deflection member in a direction from the principal wellbore;

d) pumping a first fluid down the coil tubing to rotate the drill bit downhole;

e) pumping a second fluid into an annular space between the coiled tubing and the carrier string to a position that it co-mingles with the first fluid downhole creating an underbalanced state;

f) returning a third fluid, comprising the first and second fluids and any hydrocarbons upward to the rig through the annular space between the borehole and the carrier string;

g) providing a volume of liquid within the carrier string;

h) retrieving the drill bit at the end of the coil tubing from the bore hole;

i) reorienting the direction of the deflection member to a second depth within the borehole; and j) lowering the coil tubing and drill bit to the second depth to drill a second radial well, which the well is maintained alive.

17. In a method of drilling radial wells from a principal wellbore; where there is provided a first carrier string having a deflection member on its lowermost end to a certain depth within the principal wellbore; where there is lowered a second drill string of coiled tubing, down the bore of the carrier string, so that the drill bit on the end of the second string is deflected by the deflection member in a direction from the principal wellbore; where there is pumped a first fluid down the coil tubing to rotate the drill bit downhole, and a second fluid into an annular space between the coiled tubing and the carrier string to a position that it co-mingles with the first fluid downhole; and where there is returned a third fluid, comprising the first and second fluids and any hydrocarbons upward to the rig through the annular space between the borehole and the carrier string; the improvement comprising the following steps:

a) providing a volume of liquid within the carrier string;

b) retrieving the drill bit at the end of the coil tubing from the bore hole while the volume of fluid within the carrier string maintains the well in equilibrium;

c) reorienting the direction of the deflection member to a second depth within the borehole; and d) lowering the coil tubing and drill bit to the second depth to drill a second radial well, without killing the well.

18. The method in claim 17, wherein the fluid within the carrier string comprises a co-mixture of air, nitrogen gas, and drilling fluid to maintain an equilibrium within the well bore while the drill bit is being retrieved without the fluid entering the formation.

19. The method in claim 17, further comprising the step of allowing the well to produce through an annulus established between the carrier string and the outer casing while the deflection member is being reoriented.

20. The method in claim 17, wherein an equilibrium will be established within the carrier string while each radial well is drilled, defining a continuous live producing well.

21. An improved method of drilling an underbalanced well, comprising the steps of drilling a borehole; lowering a carrier string into the borehole, and defining a first annulus between the borehole and the carrier string; providing an inner drill string within the carrier string, the inner drill string having a flowbore therethrough, and defining a second annulus between the carrier string and the inner drill string; so that fluid flowing down the flowbore of the inner drill string co-mingles with fluid flowing down the second annulus, and returns to a rig floor through the first annulus, as a co-mingled mixture comprising air, nitrogen gas, drilling fluid and hydrocarbons, maintaining an equilibrium within the borehole while a drill bit is being retrieved without the fluid entering a formation around the borehole so as to provide a continuous, live producing well.

* * * * *

UNITED STATES PATENT AND TRADEMARK OFFICE

CERTIFICATE OF CORRECTION

PATENT NO. : 5,720,356
DATED : February 24, 1998
INVENTOR(S) : Robert Gardes

It is certified that error appears in the above-identified patent and that said Letters Patent is hereby corrected as shown below:

Column 3,
Line 23, replace "hydrill" with -- annular blowout preventor --

Column 5,
Line 13, replace "hydrill" with -- annular blowout preventor --

Column 6,
Line 27, replace "36" with -- 26 --

Signed and Sealed this

Eleventh Day of February, 2003

JAMES E. ROGAN
*Director of the United States Patent and Trademark Office*